US010966016B2

(12) United States Patent
Lee et al.

(10) Patent No.: US 10,966,016 B2
(45) Date of Patent: Mar. 30, 2021

(54) ELECTRONIC DEVICE INCLUDING A PLURALITY OF SPEAKERS

(71) Applicant: Samsung Electronics Co., Ltd., Suwon-si (KR)

(72) Inventors: Byounghee Lee, Suwon-si (KR); Jihoon Song, Suwon-si (KR); Kiwon Kim, Suwon-si (KR); Myungcheol Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/654,656

(22) Filed: Oct. 16, 2019

(65) Prior Publication Data

US 2020/0128321 A1 Apr. 23, 2020

(30) Foreign Application Priority Data

Oct. 17, 2018 (KR) ..... 10-2018-0123946

(51) Int. Cl.
*H04R 1/34* (2006.01)
*H04R 1/24* (2006.01)
*H04R 1/02* (2006.01)

(52) U.S. Cl.
CPC ..... *H04R 1/345* (2013.01); *H04R 1/025* (2013.01); *H04R 1/24* (2013.01)

(58) Field of Classification Search
CPC ..... H04R 1/345; H04R 1/025; H04R 1/24
See application file for complete search history.

(56) References Cited

U.S. PATENT DOCUMENTS 5,526,456 A * 6/1996 Heinz ..... H04R 1/26 181/152
5,673,329 A 9/1997 Wiener
6,625,292 B2 * 9/2003 Proni ..... H04R 1/02 381/345
8,194,905 B1 * 6/2012 Vinther, Sr. ..... H04R 1/26 381/181
9,004,706 B1 * 4/2015 Banfield ..... F21V 33/0056 362/86
9,641,919 B1 5/2017 Poole et al.
(Continued)

FOREIGN PATENT DOCUMENTS

WO 2016054100 A1 4/2016

OTHER PUBLICATIONS

International Search Report and Written Opinion dated Jan. 22, 2020, issued in International Patent Application No. PCT/KR2019/013605.

*Primary Examiner* — Andrew L Sniezek
(74) *Attorney, Agent, or Firm* — Jefferson IP Law, LLP

(57) ABSTRACT

An electronic device including multiple speakers is provided. The electronic device includes a housing including at least one sound outlet, a first speaker disposed inside the housing, at least one sound transmission path configured to guide first sound produced by the first speaker toward the at least one sound outlet, and at least one second speaker located on the at least one sound transmission path configured to produce second sound. The at least one sound transmission path emits the first and second sounds, mixed on the at least one sound transmission path, to an outside area through the at least one sound outlet. Other various embodiments are possible.

20 Claims, 15 Drawing Sheets

(56) References Cited

U.S. PATENT DOCUMENTS

| | | | | |
|---|---|---|---|---|
| 2004/0005069 | A1* | 1/2004 | Buck | H04R 1/30 381/336 |
| 2009/0046875 | A1* | 2/2009 | Masuda | H04R 1/30 381/152 |
| 2009/0060248 | A1 | 3/2009 | Yang | |
| 2009/0087008 | A1* | 4/2009 | Danley | H04R 1/30 381/341 |
| 2011/0019862 | A1 | 1/2011 | Smith et al. | |
| 2011/0222722 | A1* | 9/2011 | Hoglund | H04R 7/16 381/423 |
| 2011/0268305 | A1* | 11/2011 | Buccafusca | H04R 1/30 381/340 |
| 2013/0058518 | A1 | 3/2013 | Held | |
| 2014/0105426 | A1* | 4/2014 | Fincham | H04S 1/002 381/160 |
| 2017/0055064 | A1 | 2/2017 | Yoo et al. | |
| 2018/0227663 | A1 | 8/2018 | Hardesty | |
| 2020/0186919 | A1* | 6/2020 | Zimmerman | G06F 3/167 |

* cited by examiner

ELECTRONIC DEVICE INCLUDING A PLURALITY OF SPEAKERS

CROSS-REFERENCE TO RELATED APPLICATION(S)

This application is based on and claims priority under 35 U.S.C. § 119(a) of a Korean patent application number 10-2018-0123946, filed on Oct. 17, 2018, in the Korean Intellectual Property Office, the disclosure of which is incorporated by reference herein in its entirety.

BACKGROUND

1. Field

The disclosure relates to an electronic device including multiple speakers.

2. Description of Related Art

Speakers used in audio are usually monotonous in terms of sound ranges capable of being provided and are generally divided into high-range speakers, middle-range speakers, and low-range speakers. Accordingly, it is impossible to properly hear a low tone from a high-range speaker, and conversely, it is impossible to properly hear a high tone from a low-range speaker. Furthermore, it is impossible to properly hear a middle-low tone or middle-high tone from a middle-range speaker.

Accordingly, multiple speakers, in which high-range speakers, mid-range speakers, and low-range speakers are separately provided, are used and have a disadvantage in that a wide installation space is required due to the increase in the number of speakers.

In order to solve this problem, a speaker device including a high-range speaker, a mid-range speaker, and a low-range speaker in a single housing has been developed.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an electronic device, in which multiple speakers are additionally mounted on at least one sound transmission path formed in a housing for space utilization of the housing or improvement of sound quality of the speakers, so that various ranges (e.g., low-range sound, middle-range sound, or high-range sound) are capable of being mixed.

When a high-range speaker, a mid-range speaker, and a low-range speaker are stacked or mounted side by side within the housing of a speaker device, a separate mounting space is required in the housing of the speaker device, or the mounting height of the housing increases, which inhibits the downsizing and slimming of a product. In addition, even if a high-range speaker, a middle-range range speaker, and a low-range speaker are separately installed in the housing to output sound in each band, there is a limit to implement harmonious sound, and thus there is a limit in listening to high quality sound.

However, the technical problems to be solved by various embodiments are not limited to the above technical problems, and other technical problems may exist.

Additional aspects will be set forth in part in the description which follows and, in part, will be apparent from the description, or may be learned by practice of the presented embodiments.

In accordance with an aspect of the disclosure, an electronic device, including a plurality of speakers, is provided. The electronic device includes a housing including at least one sound outlet, a first speaker disposed inside the housing, at least one sound transmission path configured to guide first sound produced by the first speaker toward the at least one sound outlet, and at least one second speaker located on the at least one sound transmission path, and configured to produce second sound. The at least one sound transmission path may emit the first and second sounds, mixed on the at least one sound transmission path, to an outside area through the at least one sound outlet.

In accordance with another aspect of the disclosure, an electronic device, including a plurality of speakers, is provided. The electronic device includes a housing, a first speaker disposed inside the housing, at least one sound transmission path, and at least one second speaker located on the at least one sound transmission path.

According to an embodiment, a first speaker may be disposed in a housing, and at least one second speaker may be disposed in at least one sound transmission path that guides the sound of the first speaker to the outside. For example, first sound produced by the first speaker (e.g., low-range sound) and second sound generated by the at least one second speaker (e.g., high-range sound) are mixed in the at least one sound transmission path and emitted to the outside, whereby the sounds output from the first speaker and the sound output from the at least one second speaker may compensate for each other. For example, the at least one second speaker may provide high quality sound to a listener by compensating for middle-high-range sound among the sound output from the first speaker. In addition, it is possible to improve the space utilization of a product by mounting other components of the product (e.g., a display, a microphone, a touch key, a touchscreen, a plurality of keys, or various sensors) in the space for mounting at least one second speaker in the existing housing.

According to various embodiments, since the at least one second speaker is mounted in the at least one sound transmission path of the first speaker, it is not necessary to secure a space for installing the second speaker inside the housing, and thus it is possible to reduce the size of the product, thereby downsizing or slimming the product.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
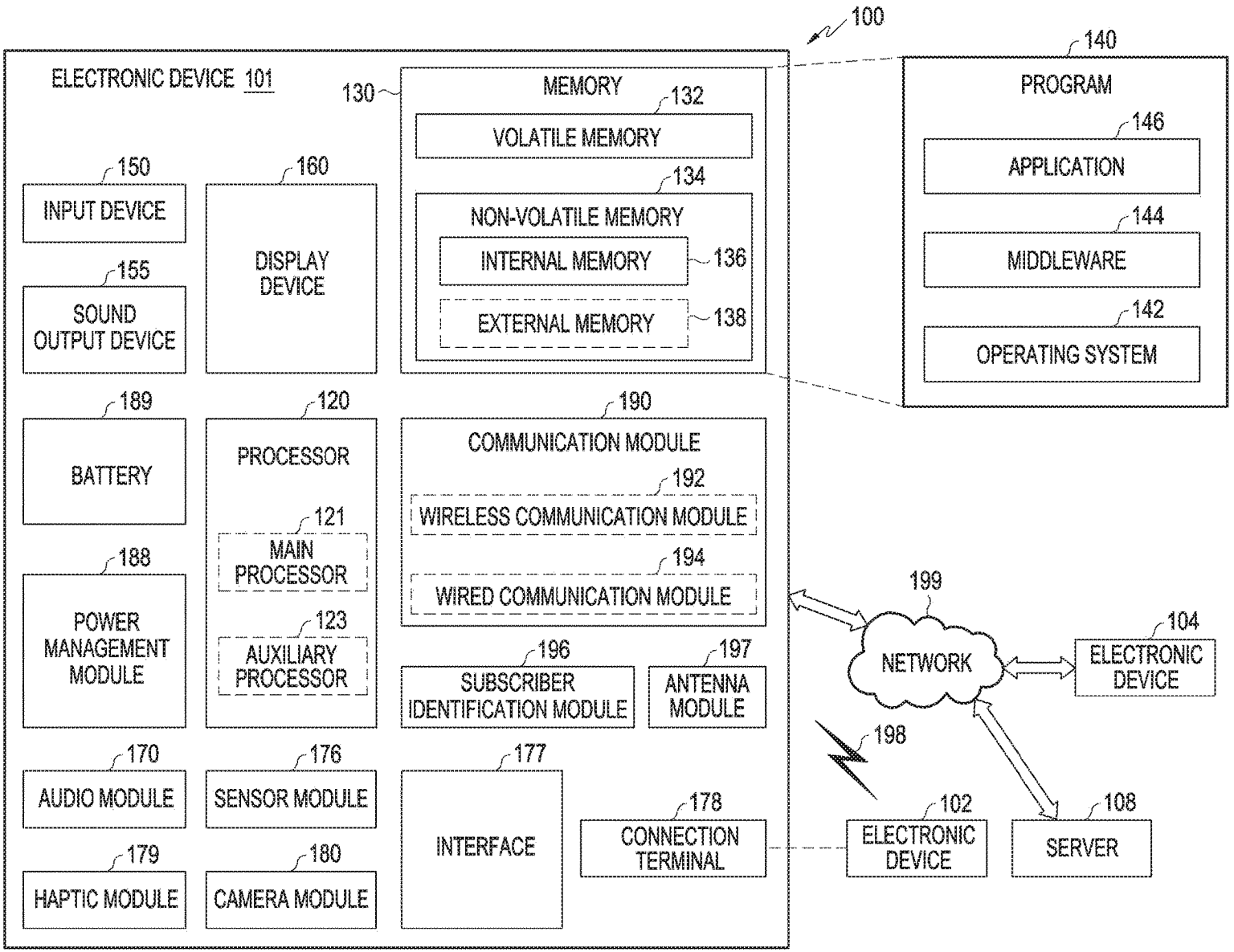
FIG. 1 is a block diagram of an electronic device in a network environment, according to an embodiment of the disclosure.

FIG. 1 is a block diagram illustrating an electronic device 101 in a network environment 100 according to various embodiments.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thererto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing recordings, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his or her tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™ wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

Figure 2:
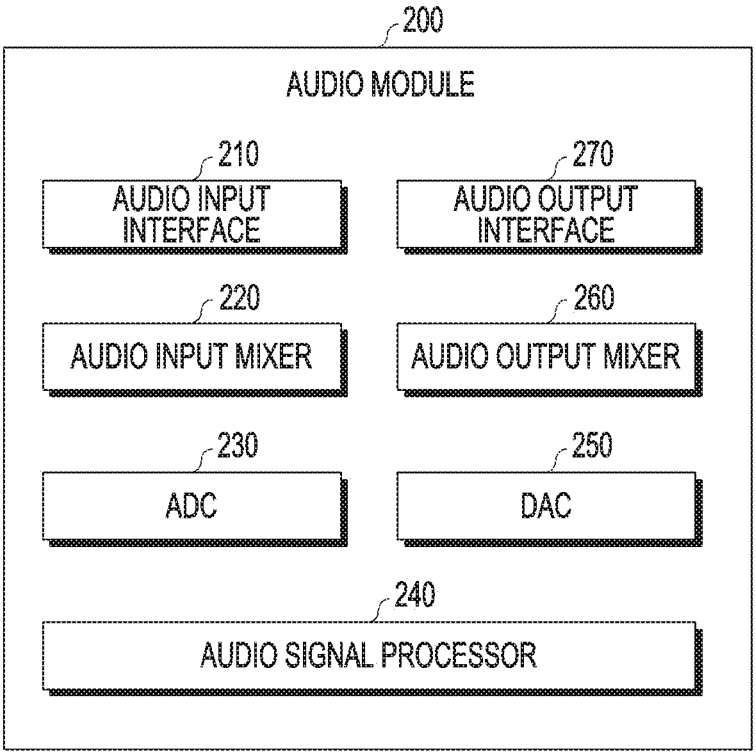
FIG. 2 is a block diagram of an audio module according to an embodiment of the disclosure.

FIG. 2 is a block diagram of an audio module according to an embodiment of the disclosure.

Referring to FIG. 2, an audio module 200 may include, for example, an audio input interface 210, an audio input mixer 220, an analog to digital converter (ADC) 230, an audio signal processor 240, and a digital to analog converter (DAC) 250, an audio output mixer 260, or an audio output interface 270.

The audio input interface 210 is a part of an input device 150, and may receive an audio signal corresponding to sound obtained from the outside of the electronic device 201 via a microphone (e.g., a dynamic microphone, a condenser microphone, or a piezo microphone) configured separately from the electronic device 201. For example, when an audio signal is obtained from an external electronic device 202 (e.g., a headset or a microphone), the audio input interface 210 may be connected to the external electronic device 202 in a wired manner via a connection terminal 278 or in a wireless manner via a wireless communication module 292 (e.g., Bluetooth communication) so as to receive an audio signal. According to an embodiment, the audio input interface 210 may receive a control signal related to the audio signal acquired from the external electronic device 202 (e.g., a volume adjustment signal using an input button). The audio input interface 210 may include a plurality of audio input channels and may receive different audio signals for respective audio input channels. According to an embodiment, additionally or alternatively, the audio input interface 210 may receive an audio signal from another component (e.g., the processor 120 or the memory 130) of the electronic device 101.

The audio input mixer 220 may mix a plurality of input audio signals into at least one audio signal. According to an embodiment, the audio input mixer 220 may mix a plurality of analog audio signals input via the audio input interface 210 into at least one analog audio signal.

The ADC 230 may convert an analog audio signal into a digital audio signal. According to an embodiment, the ADC 230 may convert an analog audio signal received via the audio input interface 210, or may additionally or alternatively convert an analog audio signal mixed via the audio input mixer 220 into a digital audio signal.

The audio signal processor 240 may perform various processing on a digital audio signal received via the ADC 230 or a digital audio signal received from another component of the electronic device 201. For example, the audio signal processor 240 may perform changing of a sampling rate, application of one or more filters, interpolation processing, amplification or attenuation (e.g., amplification or attenuation of some or all frequency bands) processing, noise processing (e.g., noise or echo attenuation), channel changing (e.g., switching between mono and stereo), mixing, or specified signal extraction on one or more digital audio signals. According to an embodiment, at least some functions of the audio signal processor 240 may be implemented in the form of an equalizer.

The DAC 250 may convert a digital audio signal into an analog audio signal. According to an embodiment, the DAC 250 may convert a digital audio signal processed by the audio signal processor 240 or a digital audio signal obtained from another component of the electronic device 201 into an analog audio signal.

The audio output mixer 260 may mix a plurality of input audio signals to be output into at least one audio signal. According to an embodiment, the audio output mixer 260 may mix audio signals converted via the DAC 250 and other analog audio signals (e.g., analog audio signals received via the audio input interface 210) into at least one analog audio signal.

The audio output interface 270 may output an analog audio signal converted via the DAC 250, or an analog audio signal additionally or substantially mixed by the audio output mixer 260 to the outside of the electronic device 201 through the audio output device 255 (e.g., a speaker (e.g., a dynamic driver, a balanced arm driver, or a receiver)). According to an embodiment, the sound output device 255 may include multiple speakers, and the audio output interface 270 may output an audio signal having a plurality of different channels (e.g., stereo or 5.1 channels) through at least some of the multiple speakers. According to an embodiment, the audio output interface 270 may be connected to the external electronic device 202 (e.g., an external speaker or a head set) in a wired manner through a connection terminal 278 or wireless manner through the wireless communication module 292 so as to output an audio signal.

According to an embodiment, the audio module 200 may not separately include the audio input mixer 220 or the audio output mixer 260 and may mix a plurality of digital audio signals using at least some functions of the audio signal processor 240 to generate at least one digital audio signal.

According to an embodiment, the audio module 200 may include an audio amplifier (not illustrated) (e.g., a speaker amplification circuit) capable of amplifying an analog audio signal input via the audio input interface 210 or an audio signal to be output through the audio output interface 270. According to an embodiment, the audio amplifier may be configured as a separate module from the audio module 270.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Figure 3:
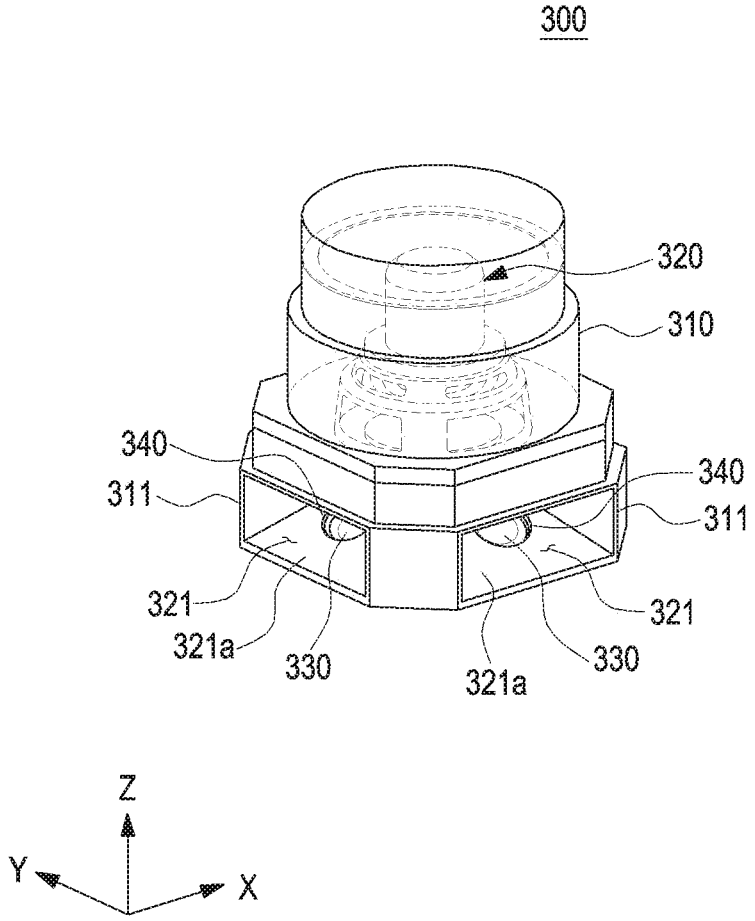
FIG. 3 is a perspective view illustrating an electronic device including multiple speakers according to an embodiment of the disclosure.

FIG. 3 is a perspective view illustrating an electronic device including multiple speakers according to an embodiment of the disclosure.

Referring to FIG. 3, an electronic device 300 (e.g., the electronic device 101 of FIG. 1) including multiple speakers according to various embodiments may include a housing 310 including at least one sound outlet 311, a first speaker 320, and at least one second speaker 330. For example, the electronic device 300 may include at least one of a speaker device or an artificial intelligence (AI) speaker mounted on a floor. The electronic device 300 may include a high efficiency omni-directional speaker device that is connected to another electronic device (e.g., the electronic devices 102 and 104 of FIG. 1) in a wired or wireless manner to reproduce sound. For example, the electronic device 300 may be mounted by making the bottom surface of the housing 310 face a floor and erecting the upper portion of the housing 310 upright from the floor.

According to various embodiments, in order to enable the electronic device 300 to be used as a speaker device, the housing 310 may be a cylindrical housing 310, and the first speaker 320 may be disposed inside the cylindrical housing 310 to be oriented in the +Z axis or −Z axis direction. At least one sound outlet 311 for emitting first sound produced by the first speaker 320 (e.g., M1 of FIG. 5A) may be formed below the cylindrical housing 310. The at least one sound outlet 311 may be formed in the X-axis direction and the Y-axis direction along the circumference of the housing 310.

The first speaker 320 and the at least one second speaker 330 may include at least one of a low-range speaker, a middle-range speaker, or a high-range speaker. For example, the first speaker 320 may include a low-range speaker or a middle-range speaker, and the at least one second speaker 330 may include a middle-range speaker or a high-range speaker. For example, the low-range speaker may include a woofer speaker that produces low-range sound (e.g., low tone sound). The middle-range speaker may include a mid-range speaker that produces middle-range sound (e.g., middle tone sound or middle-high tone sound), and the high-range speaker may include a tweeter that produces high-frequency sound (e.g., high tone sound).

According to various embodiments, the first speaker 320 may include a full-range speaker. For example, the first speaker 320 may output all of low-range sound, middle-range sound, and high-range sound. However, there may be a limit in ensuring uniform sound quality in all sound ranges through a single speaker. For example, the high-range sound quality of the first speaker 320 may be somewhat lower than the sound quality of other ranges. In an embodiment, the at least one second speaker 330 is capable of compensating for sound quality in a low performance range of the first speaker 320 (e.g., high-range sound quality) by including at least a high-range speaker (e.g., a tweeter).

According to various embodiments, the woofer speaker of the low range may generate sound having a frequency of 20 Hz to 1 kHz, and the midrange speaker of the middle range may generate sound having a frequency of 300 Hz to 5 kHz. In addition, the tweeter of the high range may generate sound having a frequency of 2 kHz to 30 kHz.

According to various embodiments, when first sound of the first speaker 320 (e.g., low-range sound) (e.g., M1 in FIG. 5B) and second sound of the at least one second speaker 330 (e.g., high-range sound) (e.g., M2 in FIG. 5B) are mixed, it is possible to provide high quality sound since the second sound of the at least one second speaker 330 (e.g., M2 in FIG. 5B) compensates for the first sound (e.g., M1 in FIG. 5B) of the first speaker 320. Inversely, it is also possible to provide high quality sound since the first sound of the first speaker 320 (e.g., M1 in FIG. 5B) compensates for the second sound of the at least one second speaker 330 (e.g., M2 in FIG. 5B). In addition, the mixed first sound and second sound (e.g., M1 and M2 in FIG. 5B) is able to provide middle-range sound to a listener. Accordingly, the listener is able to hear high quality sound.

According to various embodiments, since the at least one second speaker 330 may include a middle-range speaker, it is possible to provide the listener with middle-low-range sound while compensating for the first sound of the first speaker 320 (e.g., M1 in FIG. 5B) when the first sound of the first speaker 320 (e.g., low-range sound) (e.g., M1 in FIG. 5B) and the second sound of the at least one second speaker 330 (e.g., middle-range sound) (e.g., M2 in FIG. 5B) including a middle-range speaker are mixed with each other.

According to various embodiments, since the first speaker 320 may include a middle-range speaker, it is possible to provide the listener with middle-high-range sound while compensating for the second sound of the at least one second speaker 330 (e.g., M2 in FIG. 5B) when the first sound of the first speaker 320 (e.g., middle-range sound) (e.g., M1 in FIG. 5B) and the second sound of the at least one second speaker 330 (e.g., high-range sound) (e.g., M2 in FIG. 5B) are mixed with each other.

According to various embodiments, since the first speaker 320 may include a middle-range speaker and a low-range speaker, it is possible to provide the listener with low-range sound, high-range sound, and middle-low-range sound when the first sound of the first speaker 320 (e.g., low-range sound and middle-range sound) including a middle-range speaker and a low-range speaker and the second sound of the at least one second speaker 330 (e.g., high-range sound) are mixed with each other.

According to various embodiments, since the at least one second speaker 330 may include a middle-range speaker and a high-range speaker, it is possible to provide the listener with low-range sound, high-range sound, and middle-high-range sound when the first sound of the first speaker 320 (e.g., low-range sound) (e.g., M1 in FIG. 5B) and the second sound of the at least one second speaker 330 (e.g., middle-range sound and high-range sound) including a middle-range speaker and a high-range speaker are mixed with each other.

Figure 4:
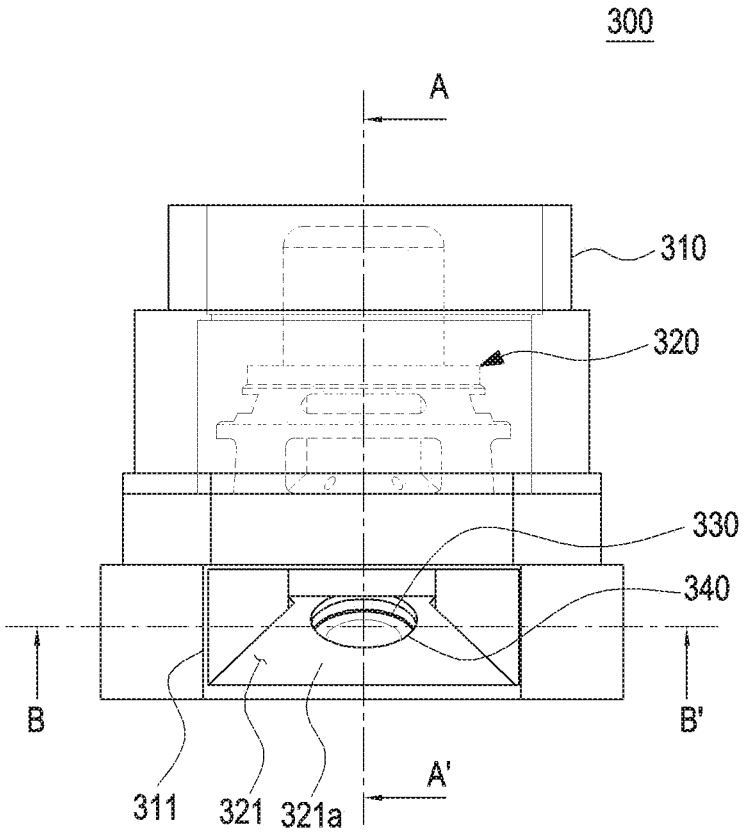
FIG. 4 is a side view illustrating an electronic device including multiple speakers according to an embodiment of the disclosure.

FIG. 4 is a side view illustrating an electronic device including multiple speakers according to an embodiment of the disclosure.

Figure 5A:
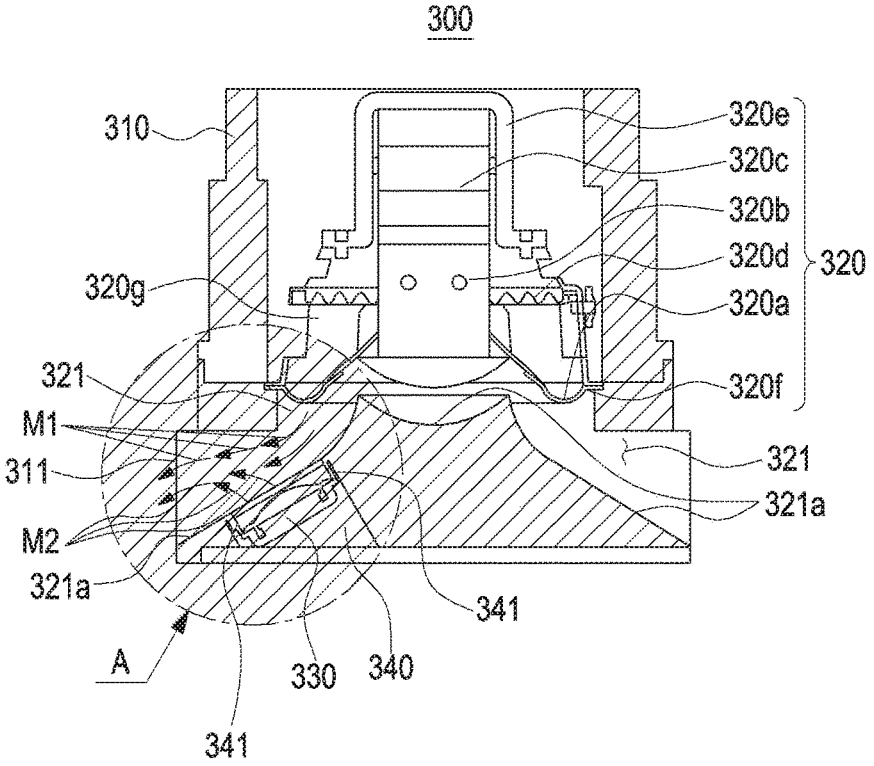
FIG. 5A is a cross-sectional view taken along line A-A' in FIG. 4 according to an embodiment of the disclosure.

FIG. 5A is a cross-sectional view taken along line A-A' in FIG. 4 according to an embodiment of the disclosure.

Figure 5B:
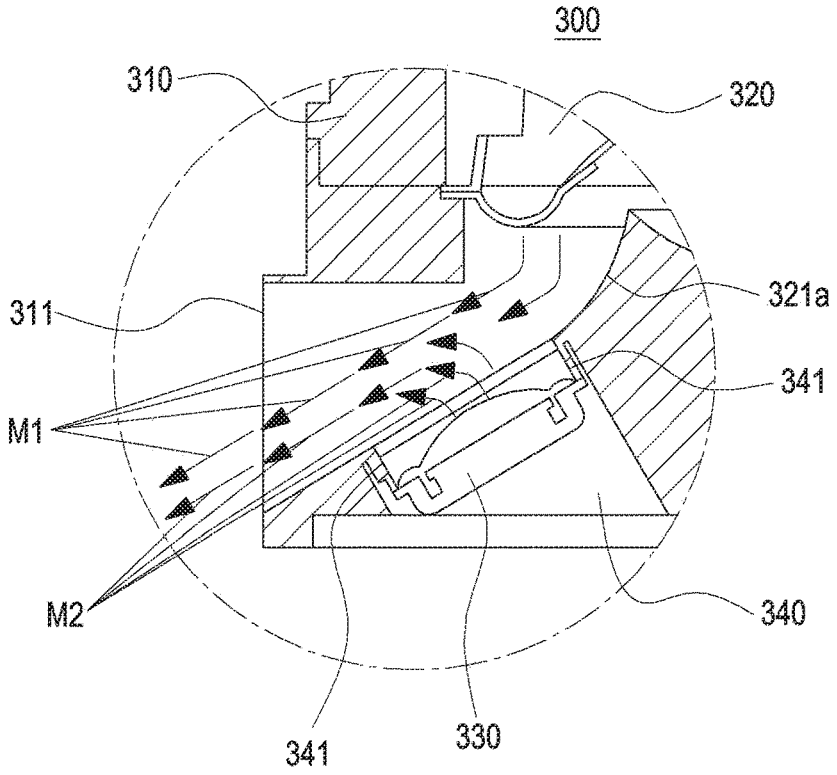
FIG. 5B is an enlarged cross-sectional view of portion "A" in FIG. 5A according to an embodiment of the disclosure.

FIG. 5B is an enlarged cross-sectional view of portion "A" in FIG. 5A.

Figure 6:
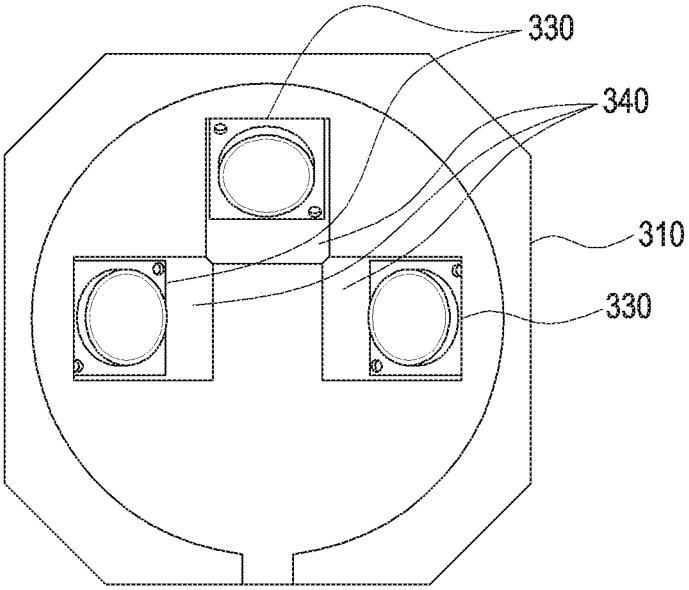
FIG. 6 is a cross-sectional view taken along line B-B' in FIG. 4 according to an embodiment of the disclosure.

FIG. 6 is a cross-sectional view taken along line B-B' in FIG. 4 according an embodiment of the disclosure.

Referring to FIGS. 4, 5A, 5B, and 6, the electronic device 300 including multiple speakers according to various embodiments may include a housing 310 including at least one sound outlet 311, a first speaker 320 for producing a first sound M1, and at least one second speaker 330 for producing second sound M2. For example, the first speaker 320 may be disposed within the housing 310 to emit sound in the Z axis direction. The first speaker 320 may include a low-range speaker for producing low-range sound (e.g., a woofer speaker or a full-range speaker).

According to various embodiments, the first speaker 320 may include, for example, a diaphragm 320*a*, a voice coil 320*b* wound around a neck portion of the diaphragm 320*a*, and a permanent magnet 320*c* adjacent to the voice coil 320*b*. The diaphragm 320*a*, the voice coil 320*b*, and the permanent magnet 320*c* may be mounted on and supported by the rigid frame 320*g*. As other components, the first speaker 320 may include a PCB damper 320*d* used as a rear suspension member 320*e*, a terminal (not illustrated) or a binding post (not illustrated) for connecting audio signals, and a gasket 320*f* for sealing a portion connected to a chassis. The diaphragm 320*a* may be provided with an inclined surface 321*a* that reflects the first sound M1 (e.g., low-range sound) or guides the traveling direction of the first sound M1. The inclined surface 321*a* may be included on a sound transmission path 321, and the inclined surface 321*a* may include an acoustic lens.

When an electrical signal is applied to the voice coil 320*b* through the PCB damper 320*d*, the diaphragm 320*a* is vibrated by an electromagnetic force generated by the current flowing through the voice coil 320*b* and the magnetic field by the permanent magnet 320*c* to produce first sound M1 (e.g., low-range sound), and the first sound M1 may be reflected by the inclined surface 321*a* formed as an acoustic lens or may be guided to the at least one sound outlet.

The first speaker 320 may include at least one sound transmission path 321 that guides the first sound M1 produced by the first speaker 320 toward the at least one sound outlet 311. For example, the first sound M1 of the first speaker 320 may move along the at least one sound transmission path 321 and may be emitted to the outside through the at least one sound outlet 311. The at least one sound transmission path 321 may include an acoustic lens that reflects or guides the first sound M1.

In this case, at least one second speaker 330 may be positioned in the at least one sound transmission path 321 in order to compensate for the function of the first speaker 320.

According to various embodiments, the at least one second speaker 330 may include a diaphragm (not illustrated) that moves back and forth to produce a pressure wave. The diaphragm may produce second sound M2 (e.g., high-range sound).

The at least one second speaker 330 may be located on the at least one sound transmission path 321 in order to mix the first sound M1 of the first speaker 320, which is a low tone, and the second sound M2 of the at least one second speaker 330, which is a high tone. For example, the at least one sound transmission path 321 may form the inclined surface 321*a*, and an inclined mounting groove 340 is formed in the inclined surface 321*a* so as to mount therein the at least one second speaker 330 to be inclined. Thus, the at least one second speaker 330 may be mounted to be inclined by being inserted into the inclined mounting groove 340. The inclined mounting groove 340 includes therein an inclined coupling unit 341 configured to fix the at least one second speaker 330 to be inclined simultaneously when coupled to the at least one second speaker 330. Thus, simultaneously when the at least one second speaker 330 is inserted into the inclined mounting groove 340, the at least one second speaker 330 may be fixedly coupled to the inclined coupling unit 341.

As described above, when the first sound M1 of a low range is produced by the first speaker 320, the first sound M1 of a low tone, which is produced by the first speaker 320, moves to the at least one sound transmission path 321, and at this time, the at least one second speaker 330 positioned on the inclined surface 321*a* of the at least one sound transmission path 321 may produce the second sound M2 of a high range. For example, even if the first speaker 320 is a full-range speaker, the sound performance of some ranges (e.g., high-range sound performance) may be lower than the sound performance of other ranges, and, in a range of relatively low performance, the at least one second speaker 330 is capable of compensating for high-range sound. The second sound M2, which is a high tone produced by the at least one second speaker 330, may move along the at least one sound transmission path 321. Thus, the first and second sounds M1 and M2 meet to be mixed on the at least one sound transmission path 321, and the mixed first and second sounds M1 and M2 are guided along the sound transmission path 321, and may be emitted to the outside of the housing 310 through the sound outlet 311. In the case of the first and second sounds M1 and M2 emitted as described above, the low-range sound produced by the first speaker 320 and the high-range sound produced by the at least one second speaker 330 are mixed on the at least one sound transmission path 321 and emitted to the outside, whereby the first and second sounds M1 and M2 are capable of compensating for the performance of the first speaker 320 or the at least one second speaker 330. Further, since it is possible to provide middle-high-range sound, the listener is able to be provided with high quality sound.

According to various embodiments, the at least one second speaker 330 is mounted in the at least one sound transmission path 321 of the first speaker 320, for example, in the space between the at least one sound transmission path 321 and the lower surface of the housing 310. Thus, it is possible to effectively utilize the internal space of the housing 310, thereby slimming down and downsizing the product. In addition, components having different functions (e.g., a display, a microphone, a touch key, a touchscreen, a plurality of keys, or various sensors) may be mounted in another space inside the housing 310. Therefore, it is possible to efficiently utilize the space of the housing 310. In addition, since the at least one second speaker 330 is disposed on at least one sound transmission path 321 of the housing 310, it is possible to prevent the at least one second speaker 330 from being exposed to the outside. This prevents the at least one second speaker 330 from being directly touched from the outside and makes the exterior design of the housing 310 beautiful.

The electronic device 300 may include a media processing device/module such as hardware, software, firmware, or a combination thereof (e.g., streaming audio/video reception device/module), and communication processing devices (e.g., a Bluetooth device, a Wi-Fi device, a cellular receiver, etc.) for directly receiving streaming media (e.g., audio/video/document) directly from sources such as a server, a cloud-based service, or other electronic devices (e.g., a smart phone, a television device, an audio player, a radio station, and a streaming media station). An embodiment of the electronic device 300 may include a user interface for controlling the reception and execution of media or media streams. In an embodiment, the user interface may include a touch controller, voice control interaction using one or more microphones, a display, a touchscreen, or the like. The electronic device 300 may include circuits, hands-free, or personal devices (e.g., an ear burg or a head set) that receive/transmit calls of cellular phones and convert either audio or at least one of audio and video (e.g., video chat or video conference).

According to various embodiments, the electronic device 300 may include a TV processing device and an antenna for receiving a TV program through the Internet (e.g., through a Wi-Fi connection, a cable, a satellite, or the air). Some embodiments may include memory devices for storing media (e.g., audio, audio/video, etc.) for reproduction in a moving state. As an example, the electronic device 300 may include a rechargeable battery or power source, a solar cell charging function, and a plug-in (e.g., AC/DC) function.

According to various embodiments, for example, the electronic device 300 may include a device that is capable of communicating with other electronic devices (e.g., the electronic devices 102 and 104 in FIG. 1), such as a smart phone, to provide information to a user when the ambient noise is too high to hear the information by the speaker of the smartphone. One or more embodiments may include processing and communication devices for communicating with a server or cloud-based server that collects information about usage, such as the type of reproduced song/audio, the date or time for use or reproduction, the amount of time the electronic device 300 has been used, and the location of use (e.g., information of another device and Bluetooth information from GPS or at a location).

According to various embodiments, the electronic device 300 may include an amplifying device for power amplification of a received audio signal or an audio signal processing device. One or more embodiments may include an audio signal processor (240 in FIG. 2) to filter/clarify a signal that may include noise.

According to various embodiments, the electronic device 300 may include an amplifier to which power is supplied (to which, e.g., USB power, DC power, or AC power is supplied).

Figure 7:
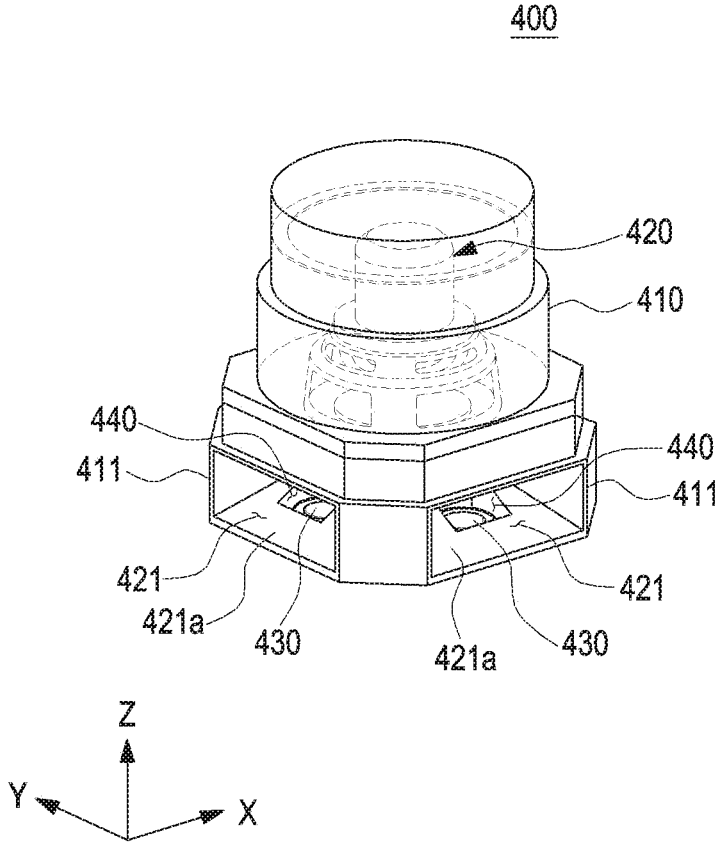
FIG. 7 is a perspective view illustrating an electronic device including multiple speakers according to an embodiment of the disclosure.

FIG. 7 is a perspective view illustrating an electronic device including multiple speakers according to an embodiment of the disclosure.

Referring to FIG. 7, the electronic device 400 including multiple speakers according to various embodiments may include a housing 410 including at least one sound outlet 411, a first speaker 420, and at least one second speaker 430. For example, the electronic device 400 may include a high efficiency omni-directional speaker device that is connected to another electronic device 400 in a wired or wireless manner to reproduce sound. In addition, the electronic device 400 may be an artificial intelligence (AI) speaker. For example, the electronic device 400 may be mounted by making the bottom surface of the housing 410 face a floor, and erecting the upper portion of the housing 410 upright from the floor.

According to various embodiments, in order to use the electronic device 400 as a speaker device, the housing 410 may include a cylindrical housing 410, and the first speaker 420 may be disposed inside the cylindrical housing 410 to be oriented in the +Z axis or −Z axis direction. The at least one sound outlet 411 for emitting first sound M1 generated by the first speaker 420 may be formed below the cylindrical housing 410. The at least one outlet 411 may be formed in the X-axis direction and the Y-axis direction along the circumference of the housing 410.

The first speaker 420 and at least one second speaker 430 may include at least one of a low-range speaker, a middle-range speaker, or a high-range speaker. For example, the first speaker 420 may include a low-range speaker or a middle-range speaker, and the at least one second speaker 430 may include a middle-range speaker or a high-range speaker. For example, the low-range speaker may include a woofer speaker that produces low-range sound (e.g., low tone sound). The middle-range speaker may include a midrange speaker that produces middle-range sound (e.g., middle tone sound or middle-high tone sound), and the high-range speaker may include a tweeter that produces high-frequency sound (e.g., high tone sound).

According to various embodiments, the first speaker 420 may include a full-range speaker. For example, the first speaker 420 may output all of low-range sound, middle-range sound, and high-range sound. However, there may be a limit in ensuring uniform sound quality in all sound ranges through a single speaker. For example, the high-range sound quality of the first speaker 420 may be somewhat lower than the sound quality of other ranges. In an embodiment, the at least one second speaker 430 is capable of compensating for sound quality in a low performance range of the first speaker 420 (e.g., high-range sound quality) by including at least a high-range speaker (e.g., a tweeter).

Figure 8:
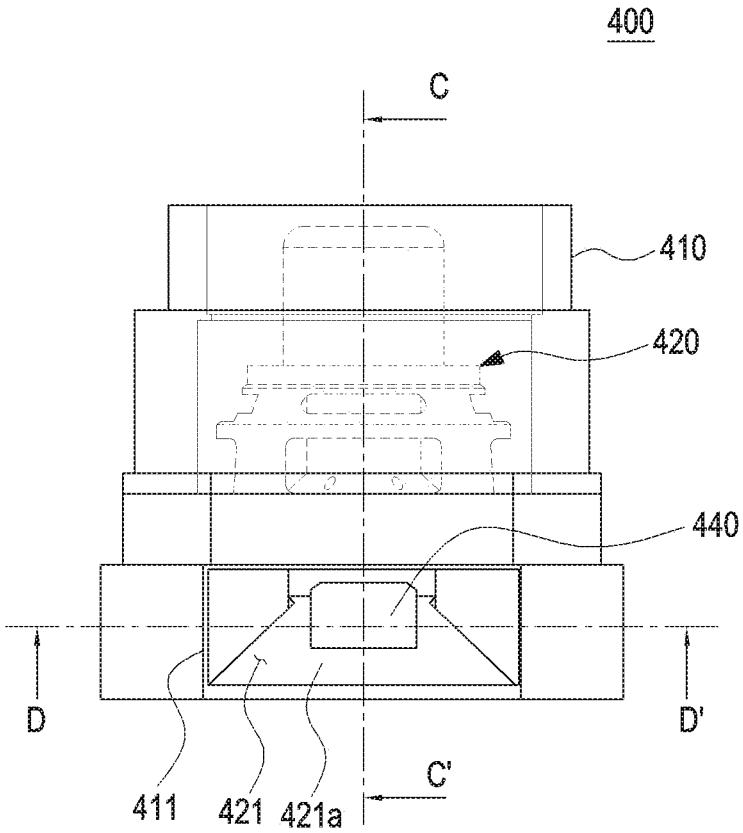
FIG. 8 is a side view illustrating an electronic device including multiple speakers according to an embodiment of the disclosure.

FIG. 8 is a side view illustrating an electronic device including multiple speakers according to an embodiment of the disclosure.

Figure 9A:
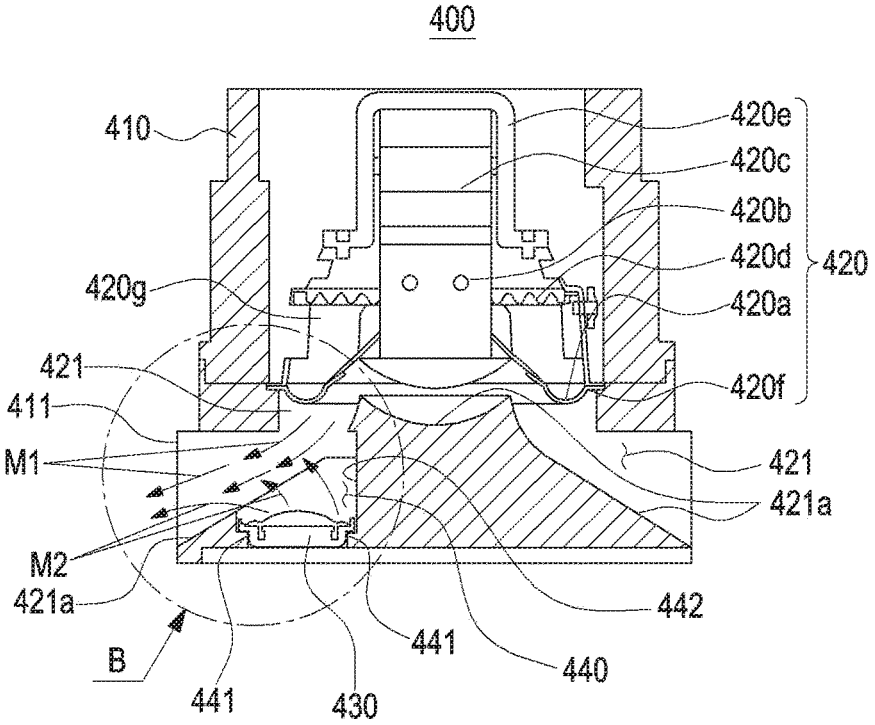
FIG. 9A is a cross-sectional view taken along line C-C' in FIG. 8 according to an embodiment of the disclosure.

FIG. 9A is a cross-sectional view taken along line C-C' in FIG. 8 according to an embodiment of the disclosure.

Figure 9B:
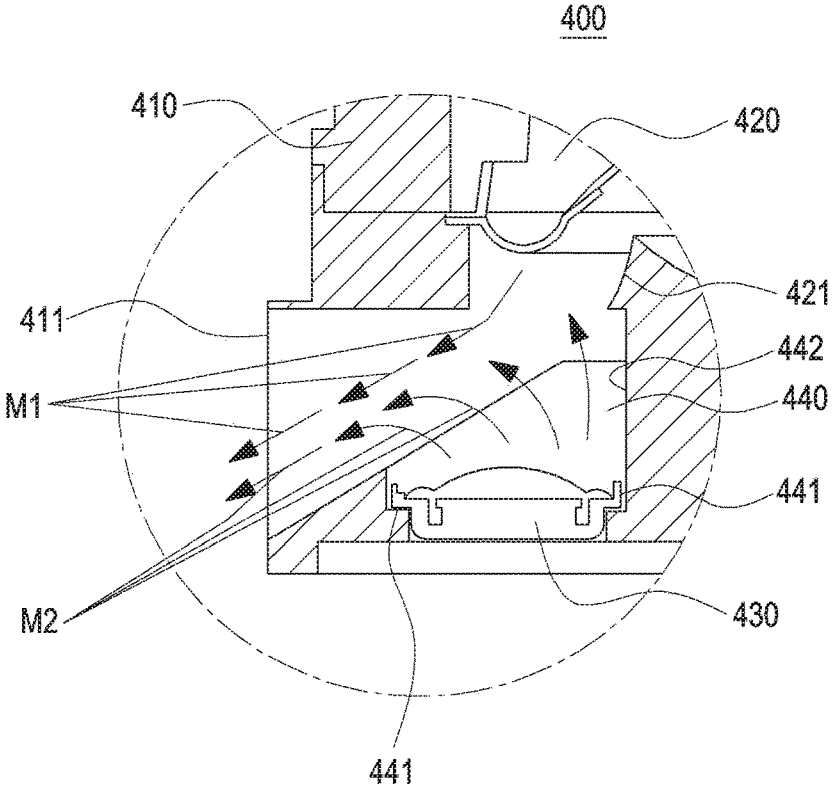
FIG. 9B is an enlarged cross-sectional view of portion "B" in FIG. 9A according to an embodiment of the disclosure.

FIG. 9B is an enlarged cross-sectional view of portion "B" in FIG. 9A according to an embodiment of the disclosure.

Figure 10:
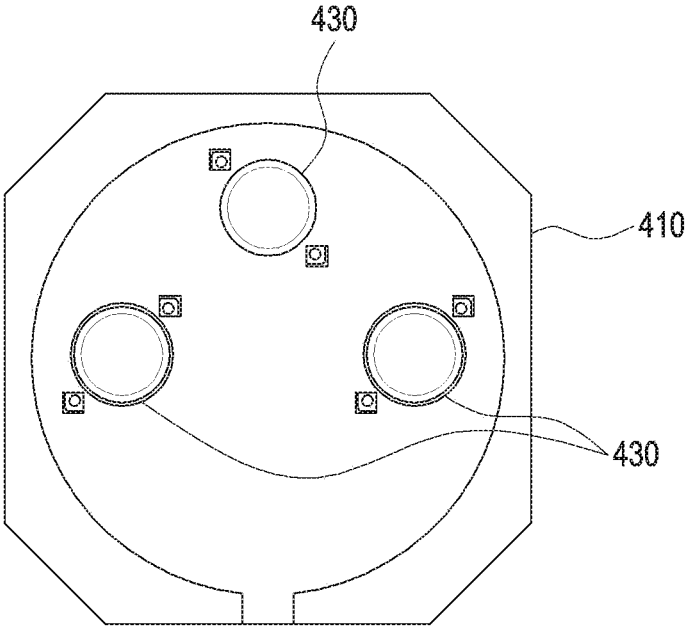
FIG. 10 is a cross-sectional view taken along line D-D' in FIG. 8 according to an embodiment of the disclosure.

FIG. 10 is a cross-sectional view taken along line D-D' in FIG. 8 according to an embodiment of the disclosure.

Referring to FIGS. 8, 9A, 9B, and 10, the electronic device 400 including multiple speakers according to various embodiments may include a housing 410 including at least one sound outlet 411, a first speaker 420 for producing a first sound M1, and at least one second speaker 430 for producing second sound M2. For example, the first speaker 420 may be disposed upright in the Z axis direction (see, for example, FIG. 7) within the housing 410. The first speaker 420 may include a low-range speaker for producing low-range sound (e.g., a woofer speaker or a full-range speaker).

According to various embodiments, the first speaker 420 may include a diaphragm 420*a*, a voice coil 420*b*, and a permanent magnet 420*c*. The diaphragm 420*a*, the voice coil 420*b*, and the permanent magnet 420*c* may be mounted on and supported by the rigid frame 420*g*. The first speaker 420 may include a PCB damper 420*d* used as a rear suspension member 420*e*, a terminal (not illustrated) or a binding post (not illustrated) for connecting audio signals, and a gasket 420*f* for sealing a portion connected to a chassis. The diaphragm 420*a* may be provided with an inclined surface 421*a* that reflects the first sound M1 (e.g., low-range sound) or guides the traveling direction of the first sound M1. The inclined surface 421*a* may be included on at least one sound transmission path 421, and the inclined surface 421*a* may include an acoustic lens.

At least one of the components of the first speaker 420 may be the same as or similar to at least one of the components of the first speaker 420 of FIG. 5A, and redundant descriptions will be omitted below.

According to various embodiments, the first speaker 420 may include at least one sound transmission path 421 that guides the first sound M1 produced by the first speaker 420 toward the at least one sound outlet 411. For example, the first sound M1 of the first speaker 420 may move along the at least one sound transmission path 421 and may be emitted to the outside through the at least one sound outlet 411. The at least one sound transmission path 421 may include an acoustic lens that reflects or guides the first sound M1.

In this case, at least one second speaker 430 may be positioned in the at least one sound transmission path 421 in order to compensate for the function of the first speaker 420.

According to various embodiments, the at least one second speaker 430 may include a diaphragm (not illustrates) that moves back and forth to produce a pressure wave. The diaphragm may produce second sound M2 (e.g. high-range sound).

The at least one second speaker 430 may be located on the at least one sound transmission path 421 in order to mix the first sound M1 of the first speaker 420, which is a low tone, and the second sound M2 of the at least one second speaker 430, which is a high tone. For example, the at least one sound transmission path 421 may form the inclined surface 421*a*, and a horizontal mounting groove 440 is formed in the inclined surface 421*a* so as to mount therein the at least one second speaker 430 horizontally in the X axis direction (see, for example, FIG. 7) or in the Y axis direction (see, for example, FIG. 7) with reference to the housing 410. Thus, the at least one second speaker 430 may be horizontally mounted by being inserted into the horizontal mounting groove 440. The horizontal mounting groove 440 includes therein a horizontal coupling unit 441 configured to horizontally fix the at least one second speaker 430 simultaneously when coupled to the at least one second speaker 430. Thus, simultaneously when the at least one second speaker 430 is horizontally inserted into the horizontal mounting groove 440, the at least one second speaker 430 may be fixedly coupled to the horizontal coupling unit 441. For example, the horizontal mounting groove 440 is formed to be recessed in the Z-axis direction of the housing 410 in the inclined surface 421*a*, and the at least one second speaker 430 may be horizontally disposed in the horizontal mounting groove 440 formed as described above.

As described above, when the first sound M1 of a low range is produced by the first speaker 420, the first sound M1 of a low range, which is produced by the first speaker 420, moves to the at least one sound transmission path 421, and at this time, the at least one second speaker 430 horizontally positioned on the inclined surface of the at least one sound transmission path 421 may produce the second sound M2 of a high range. Since the horizontal mounting groove 440 is formed with a linear movement emission path 442 for guiding the movement of the second sound M2 of a high range, the linear movement emission path 442 may guide the movement of the second sound M2, and may linearly emit the second sound M2 to the front side of the at least one second speaker 430. For example, when the at least one second speaker 430 emits and raises the second sound M2 to the front side of the housing 410 in the Z axis direction, the raised second sound M2 moves to the at least one sound transmission path 421 of the first speaker 420, and at the same time, may be mixed with the first sound M1 moving along the at least one sound transmission path 421 of the first speaker 420.

The first and second sounds M1 and M2 mixed as described above move along the at least one sound transmission path 421 of the first speaker 420 are guided to the sound outlet 411 formed in the housing 410 and emitted to the outside of the housing 410.

In the case of the first and second sounds M1 and M2, the low-range sound produced by the first speaker 420 and the high-range sound produced by the at least one second speaker 430 are mixed on the at least one sound transmission path 421 and emitted to the outside, whereby the first and second sounds M1 and M2 are capable of mutually further compensating for the performance of the first speaker 420 or the at least one second speaker 430. Further, since the mixed first and second sounds M1 and M2 are capable of providing middle-high-range sound to the listener, the listener is able to listen to high quality sound.

Figure 11A:
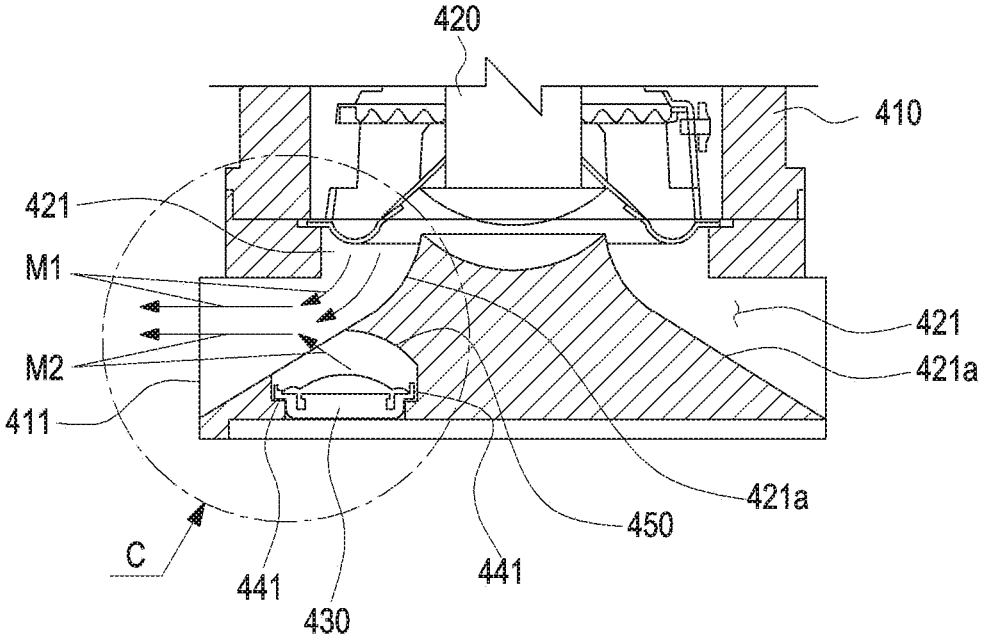
FIG. 11A is a side cross-sectional view illustrating an electronic device including multiple speakers according to an embodiment of the disclosure.

FIG. 11A is a side cross-sectional view illustrating an electronic device including multiple speakers according to an embodiment of the disclosure.

Figure 11B:
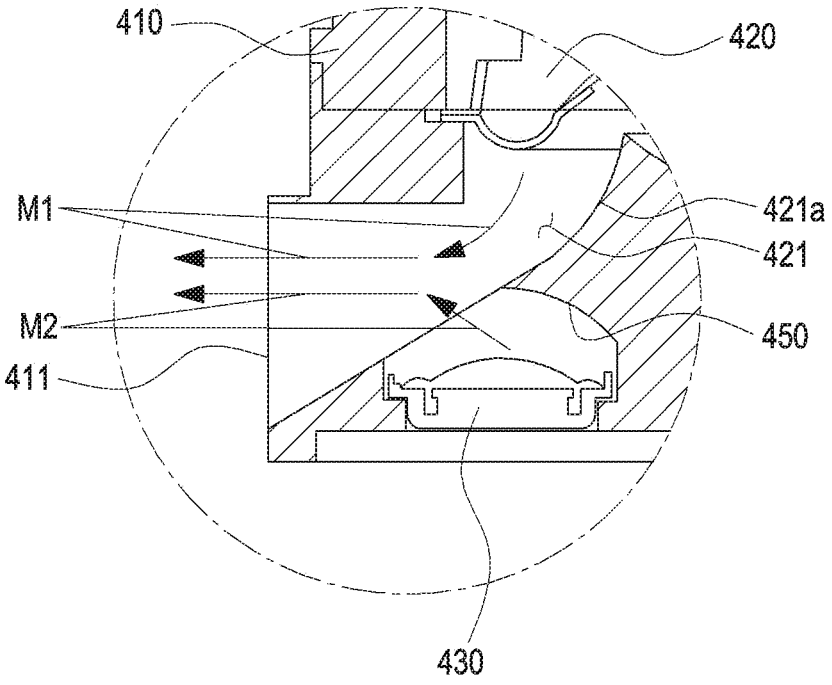
FIG. 11B is an enlarged cross-sectional view of portion "C" in FIG. 11A according to an embodiment of the disclosure.

FIG. 11B is an enlarged cross-sectional view of portion "C" in FIG. 11A according to an embodiment of the disclosure.

Referring to FIGS. 11A and 11B, the electronic device including multiple speakers according to various embodiments may include a housing 410 including at least one sound outlet, a first speaker 420 for producing a first sound M1, and at least one second speaker 430 for producing second sound M2.

The at least one second speaker 430 may be located on the at least one sound transmission path 421 in order to mix the first sound M1 of the first speaker 420, which is a low tone, and the second sound M2 of the at least one second speaker 430, which is a high range. For example, the at least one sound transmission path 421 may form the inclined surface 421*a*, and a horizontal mounting groove 440 is formed in the inclined surface 421*a* so as to mount therein the at least one second speaker 430 horizontally in the X axis direction or in the Y axis direction with reference to the housing 410. Thus, the at least one second speaker 430 may be horizontally mounted by being inserted into the horizontal mounting groove 440. The horizontal mounting groove 440 includes therein a horizontal coupling unit 441 configured to horizontally fix the at least one second speaker 430 simultaneously when coupled to the at least one second speaker 430. Thus, simultaneously when the at least one second speaker 430 is horizontally inserted into the horizontal mounting groove 440, the at least one second speaker 430 may be fixedly coupled to the horizontal coupling unit 441.

In the horizontal mounting groove 440, a curved movement emission path 450 is formed to guide the second sound M2 produced by the at least one second speaker 430 in a curved form to move the second sound M2 to the at least one sound transmission path 421 of the first speaker 420.

As described above, when the first sound M1 of a low range is produced by the first speaker 420, the first sound M1 of a low tone, which is produced by the first speaker 420, moves to the sound transmission path 421 of the first speaker 420, and at this time, the at least one second speaker 430 positioned on the inclined surface 421*a* of the at least one sound transmission path 421 may produce the second sound M2 of a high range. The curved movement emission path 450 may guide the produced high range second sound M2 in a curved form. The second sound M2 may be moved in a curve form by the curved movement emission path 450 and may be mixed with the first sound M1.

The first and second sounds M1 and M2 mixed as described above move along the at least one sound transmission path 421 of the first speaker 420 are guided to the sound outlet formed in the housing 410 and emitted to the outside of the housing 410.

The mixed first and second sounds M1 and M2 may spread to the outside of the housing 410 and at the same time, allow the listener to hear higher quality sound. In other words, the electronic device may include at least one second speaker 430 that compensates for the performance of the first speaker 420 to provide the listener with further improved higher quality sound.

Figure 12:
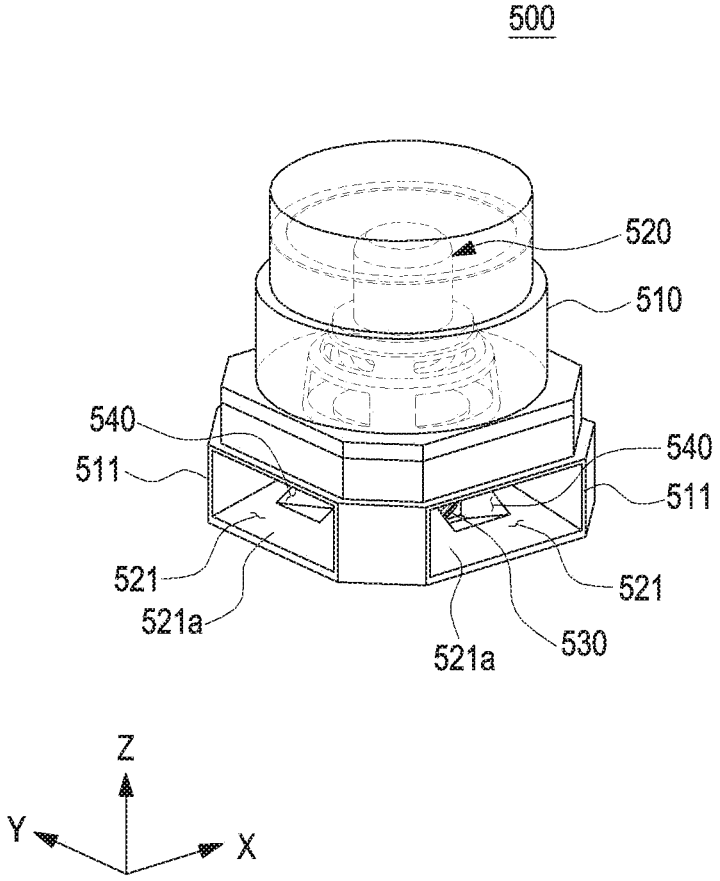
FIG. 12 is a perspective view illustrating an electronic device including multiple speakers according to an embodiment of the disclosure.

FIG. 12 is a perspective view illustrating an electronic device including multiple speakers according to an embodiment of the disclosure.

Referring to FIG. 12, the electronic device 500 including multiple speakers according to various embodiments may include a housing 510 including at least one sound outlet 511, a first speaker 520, and at least one second speaker 530. For example, the electronic device 500 may include a high efficiency omni-directional speaker device that is connected to another electronic device 500 in a wired or wireless manner to reproduce sound. In addition, the electronic device 500 may be an artificial intelligence (AI) speaker. For example, the electronic device 500 may be mounted by making the bottom surface of the housing 510 face a floor, and erecting the upper portion of the housing 510 upright from the floor.

According to various embodiments, in order to use the electronic device 500 as a speaker device, the housing 510 may include a cylindrical housing 510, and the first speaker 520 may be disposed inside the cylindrical housing 510 to be oriented in the +Z axis or −Z axis direction. The at least one sound outlet 511 for emitting first sound M1 generated by the first speaker 520 may be formed below the cylindrical housing 510. The at least one sound outlet 511 may be formed in the X-axis direction and the Y-axis direction along the circumference of the housing 510.

The first speaker 520 and the at least one second speaker 530 may include at least one of a low-range speaker, a middle-range speaker, or a high-range speaker. For example, the first speaker 520 may include a low-range speaker or a middle-range speaker, and the at least one second speaker 530 may include a middle-range speaker or a high-range speaker. For example, the low-range speaker may include a woofer speaker that produces low-range sound (e.g., low tone sound). The middle-range speaker may include a mid-range speaker that produces middle-range sound (e.g., middle tone sound or middle-high tone sound), and the high-range speaker may include a tweeter that produces high-frequency sound (e.g., high tone sound).

Figure 13:
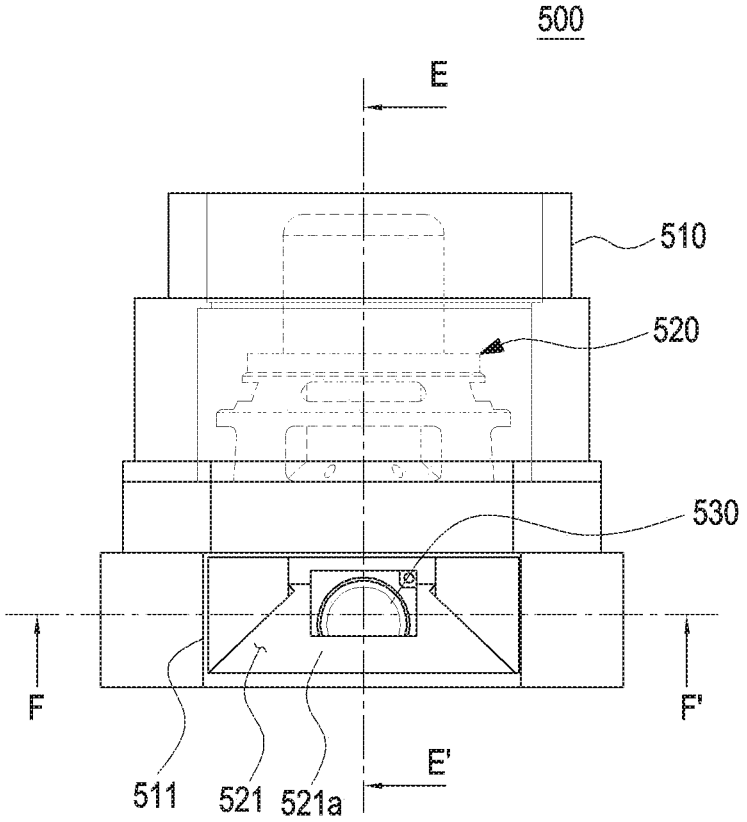
FIG. 13 is a side view illustrating an electronic device including multiple speakers according to an embodiment of the disclosure.

FIG. 13 is a side view illustrating an electronic device including multiple speakers according to an embodiment of the disclosure.

Figure 14A:
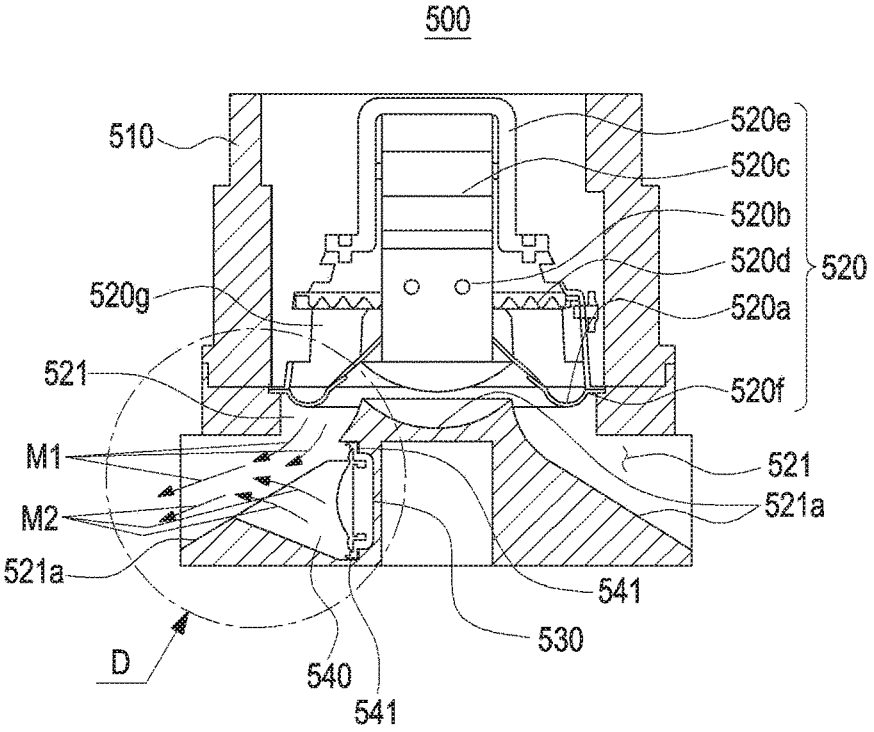
FIG. 14A is a cross-sectional view taken along line E-E' in FIG. 13 according to an embodiment of the disclosure.

FIG. 14A is a cross-sectional view taken along line E-E' in FIG. 13 according to an embodiment of the disclosure.

Figure 14B:
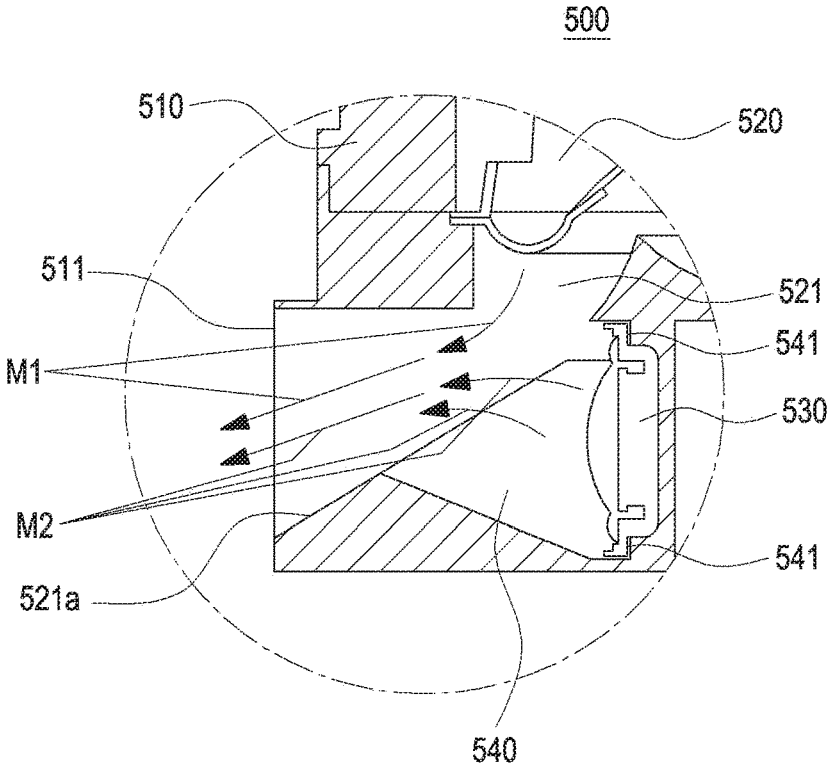
FIG. 14B is an enlarged cross-sectional view of portion "D" in FIG. 14A according to an embodiment of the disclosure.

FIG. 14B is an enlarged cross-sectional view of portion "D" in FIG. 14A according to an embodiment of the disclosure.

Figure 15:
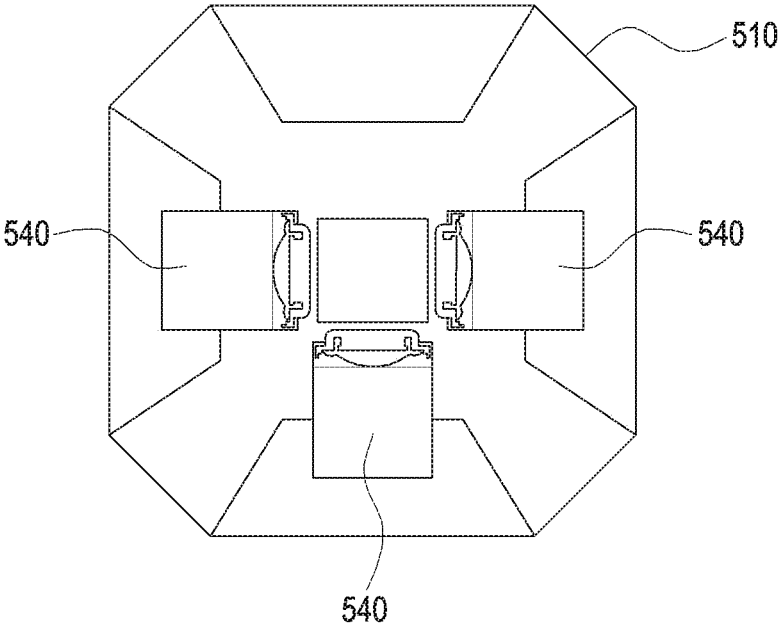
FIG. 15 is a cross-sectional view taken along line F-F' in FIG. 13 according to an embodiment of the disclosure.

FIG. 15 is a cross-sectional view taken along line F-F' in FIG. 13 according to an embodiment of the disclosure.

Referring to FIGS. 13, 14A, 14B, and 15, the electronic device 500 including multiple speakers according to various embodiments may include a housing 510 including at least one sound outlet 511, a first speaker 520 for producing a first sound M1, and at least one second speaker 530 for producing second sound M2. For example, the first speaker 520 may include a diaphragm 520*a*, a voice coil 520*b*, and a permanent magnet 520*c*. The diaphragm 520*a*, the voice coil 520*b*, and the permanent magnet 520*c* may be mounted on and supported by the rigid frame 520*g*. The first speaker 520 may include a PCB damper 520*d* used as a rear suspension member 520*e*, a terminal (not illustrated) or a binding post (not illustrated) for connecting audio signals, and a gasket 520*f* for sealing a portion connected to a chassis. The diaphragm 520*a* may be provided with an inclined surface 521*a* that reflects the first sound M1 (e.g., low-range sound) or guides the traveling direction of the first sound M1. The inclined surface 521*a* may be included on a sound transmission path 521, and the inclined surface 521*a* may include an acoustic lens.

At least one of the components of the first speaker 520 may be the same as or similar to at least one of the components of the first speaker 520 of FIG. 5A, and redundant descriptions will be omitted below.

According to various embodiments, the first speaker 520 may include at least one sound transmission path 521 that guides the first sound M1 produced by the first speaker 520 toward the at least one sound outlet 511. For example, the first sound M1 of the first speaker 520 may move along the at least one sound transmission path 521 and may be emitted to the outside through the at least one sound outlet 511. The at least one sound transmission path 521 may include an acoustic lens that reflects or guides the first sound M1.

In this case, at least one second speaker 530 may be positioned in the at least one sound transmission path 521 in order to compensate for the function of the first speaker 520.

According to various embodiments, the at least one second speaker 530 may include a diaphragm (not illustrated), and the diaphragm may produce a second sound M2 (e.g., high range sound).

The at least one second speaker 530 may be located on the at least one sound transmission path 521 in order to mix the first sound M1 of the first speaker 520, which is a low tone, and the second sound M2 of the at least one second speaker 530, which is a high tone. For example, the at least one sound transmission path 521 may form the inclined surface 521*a*, and a vertical mounting groove 540 is formed in the inclined surface 521*a* so as to mount therein the at least one second speaker 530 vertically in the Z axis direction (see, for example, FIG. 12) with reference to the housing 510. Thus, the at least one second speaker 530 may be vertically mounted by being inserted into the vertical mounting groove 540. The vertical mounting groove 540 includes therein a vertical coupling unit 541 configured to vertically fix the at least one second speaker 530 simultaneously when coupled to the at least one second speaker 530. Thus, simultaneously when the at least one second speaker 530 is vertically inserted into the vertical mounting groove 540, the at least one second speaker 530 may be fixedly coupled to the vertical coupling unit 541. For example, the vertical mounting groove 540 is horizontally formed to be recessed in the X-axis direction (see, for example, FIG. 12) or Y-axis direction (see, for example, FIG. 12) of the housing 510 in the inclined surface, and the at least one second speaker 530 may be vertically disposed in the vertical mounting groove 540 formed as described above.

As described above, when the first sound M1 of a low range is produced by the first speaker 520, the first sound M1 of a low tone, which is produced by the first speaker 520, moves to the at least one sound transmission path 521, and at this time, the at least one second speaker 530 vertically positioned on the inclined surface 521*a* of the at least one sound transmission path 521 may horizontally produce and emit the second sound M2 of a high range. Since the vertical mounting groove 540 is formed with a horizontal movement emission path for guiding the horizontal movement of the second sound M2 of a high range, the horizontal movement emission path may horizontally guide the movement of the second sound M2 and may horizontally emit the second sound M2 to the front side of the at least one second speaker 530. For example, when the at least one second speaker 530 emits and horizontally moves the second sound M2 to the front side of the housing 510 in the X axis direction or Y axis direction, the horizontally moved second sound M2 moves to the at least one sound transmission path 521 of the first speaker 520 and at the same time may be mixed with the first sound M1 moving along the at least one sound transmission path 521 of the first speaker 520.

The first and second sounds M1 and M2 mixed as described above move along the sound transmission path 521 of the first speaker 520, are guided to the at least one sound outlet 511 formed in the housing 510, and are emitted to the outside of the housing 510.

As described above, the second sound M2 may be horizontally moved by the horizontal movement emission path, and the second sound M2 that is horizontally moved in this way may be easily mixed with the first sound M1 on the at least one sound transmission path 521 of the first speaker 520.

Accordingly, in the case of the first and second sounds M1 and M2, the low-range sound produced by the first speaker 520 and the high-range sound produced by the at least one second speaker 530 are mixed on the at least one sound transmission path 521 and emitted to the outside, whereby the first and second mounds M1 and M2 may further compensate for the performance of the first speaker 520 or the at least one second speaker 530. Further, since the mixed first and second sounds M1 and M2 are capable of providing middle-high-range sound to the listener, it is accordingly possible to provide further improved, higher quality sound to the listener.

According to various embodiments, an electronic device (300 in FIG. 3), including multiple speakers, includes: a housing (310 in FIG. 3) including at least one sound outlet (311 in FIG. 3); a first speaker (320 in FIG. 3) disposed inside the housing; at least one sound transmission path (321 in FIG. 3) configured to guide first sound (M1 in FIG. 5B) produced by the first speaker toward the at least one sound outlet; and at least one second speaker (330 in FIG. 3) located on the at least one sound transmission path, and configured to produce second sound (M2 in FIG. 5B). The at least one sound transmission path emits the first and second sounds, mixed on the at least one sound transmission path, to an outside area through the at least one sound outlet. Other various embodiments are possible.

According to various embodiments, the housing may include a cylindrical housing, and the at least one sound outlet may be formed below the cylindrical housing.

According to various embodiments, the first speaker may include at least one of a low-range speaker, a middle-range speaker, and a full-range speaker, and the second speaker may include at least one of a middle-range speaker and a high-range speaker.

According to various embodiments, the low-range speaker may include a woofer speaker configured to produce low-range sound.

According to various embodiments, the middle-range speaker may include a midrange speaker configured to produce middle-range sound.

According to various embodiments, the high-range speaker may include a tweeter configured to produce high-range sound.

According to various embodiments, the at least one sound transmission path may form an inclined surface (321*a* in FIG. 5B), and the inclined surface may have an inclined mounting groove (340 in FIG. 5B) formed therein to mount the at least one second speaker to be inclined.

According to various embodiments, the inclined mounting groove may include therein an inclined coupling unit (341 in FIG. 5B) configured to be coupled to the at least one second speaker.

According to various embodiments, the inclined surface may have a horizontal mounting groove (440 in FIG. 9B) formed therein to horizontally mount the at least one second speaker with reference to the housing.

According to various embodiments, the horizontal mounting groove may include therein a horizontal coupling unit (441 in FIG. 9B) configured to be coupled to the at least one second speaker.

According to various embodiments, the horizontal mounting groove is provided with a linear movement emission path (442 in FIG. 9B) configured to linearly move the second sound.

According to various embodiments, the horizontal mounting groove is provided with a curved movement emission path (450 in FIG. 11B) configured to move the second sound in a curved form.

According to various embodiments, the inclined surface may have a vertical mounting groove (540 in FIG. 14B) formed therein to vertically mount the at least one second speaker with reference to the housing.

According to various embodiments, the vertical mounting groove may include therein a vertical coupling unit (541 in FIG. 14B) configured to be coupled to the at least one second speaker.

According to various embodiments, the at least one sound transmission path may include a space that causes the first sound and the second sound to be mixed with each other and moves the mixed first and second sounds to the sound outlet.

According to various embodiments, the electronic device may include at least one of a speaker device or an artificial intelligence (AI) speaker.

According to various embodiments, an electronic device, including multiple speakers, includes a housing, a first speaker disposed inside the housing, at least one sound transmission path, and at least one second speaker located on the at least one sound transmission path.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a housing including at least one sound outlet;

a first speaker disposed inside the housing;

at least one sound transmission path configured to guide a first sound produced by the first speaker toward the at least one sound outlet; and at least one second speaker located on the at least one sound transmission path, and configured to produce a second sound, wherein the at least one sound transmission path is configured to emit the first sound and the second sound, which are mixed on the at least one sound transmission path, to an outside of the housing through the at least one sound outlet, wherein the at least one sound transmission path includes a first inclined surface and a second inclined surface, wherein the first inclined surface is configured to reflect the first sound or to guide a traveling direction of the first sound, and the second inclined surface includes a mounting groove for mounting the at least one second speaker, and wherein the first inclined surface includes an acoustic lens and a first end of the second inclined surface adjoins a first end of the first inclined surface.

2. The electronic device of claim 1, wherein the housing includes a cylindrical housing, and wherein the at least one sound outlet is formed below the cylindrical housing.

3. The electronic device of claim 1, wherein the first speaker includes at least one of a low-range speaker, a middle-range speaker, or a full-range speaker, and wherein the at least one second speaker includes at least one of a middle-range speaker or a high-range speaker.

4. The electronic device of claim 3, wherein the low-range speaker includes at least one woofer speaker configured to produce low-range sound.

5. The electronic device of claim 3, wherein the middle-range speaker includes a midrange speaker configured to produce middle-range sound.

6. The electronic device of claim 3, wherein the high-range speaker includes a tweeter configured to produce high-range sound.

7. The electronic device of claim 1, wherein the second inclined surface includes an inclined mounting groove formed therein to mount the at least one second speaker to be inclined.

8. The electronic device of claim 7, wherein the inclined mounting groove includes therein an inclined coupling unit configured to be coupled to the at least one second speaker.

9. The electronic device of claim 1, wherein the second inclined surface has a horizontal mounting groove formed therein to horizontally mount the at least one second speaker with reference to the housing.

10. The electronic device of claim 9, wherein the horizontal mounting groove includes therein a horizontal coupling unit configured to be coupled to the at least one second speaker.

11. The electronic device of claim 9, wherein the horizontal mounting groove is provided with a linear movement emission path configured to linearly move the second sound.

12. The electronic device of claim 9, wherein the horizontal mounting groove is provided with a curved movement emission path configured to move the second sound in a curved form.

13. The electronic device of claim 1, wherein the second inclined surface has a vertical mounting groove formed therein to vertically mount the at least one second speaker with reference to the housing.

14. The electronic device of claim 13, wherein the vertical mounting groove includes therein a vertical coupling unit configured to be coupled to the at least one second speaker.

15. The electronic device of claim 1, wherein the at least one sound transmission path includes a space that causes the first sound and the second sound to be mixed with each other and moves the mixed first and second sounds to the at least one sound outlet.

16. The electronic device of claim 1, wherein the electronic device includes an artificial intelligence (AI) speaker.

17. An electronic device comprising:

a housing;

a first speaker disposed inside the housing, and including at least one sound transmission path; and at least one second speaker located on the at least one sound transmission path, wherein the at least one sound transmission path includes a first inclined surface and a second inclined surface, wherein the first inclined surface is configured to reflect a first sound or to guide a traveling direction of the first sound, and the second inclined surface includes a mounting groove for mounting the at least one second speaker, and wherein the first inclined surface includes an acoustic lens and a first end of the second inclined surface adjoins a first end of the first inclined surface.

18. The electronic device of claim 17, wherein the at least one sound transmission path is configured to emit the first sound produced by the first speaker and a second sound produced by the at least one second speaker, the first sound and the second sound being mixed on the at least one sound transmission path, to an outside of the housing through a sound outlet formed in the at least one sound transmission path.

19. The electronic device of claim 17, wherein the first speaker includes at least one of a middle-range speaker or a full-range speaker, and wherein the at least one second speaker includes at least one of a middle-range speaker or a high-range speaker.

20. The electronic device of claim 19, wherein a low-range speaker includes a woofer speaker configured to produce low-range sound, wherein the middle-range speaker includes a midrange speaker configured to produce middle-range sound, and wherein the high-range speaker includes a tweeter configured to produce high-range sound.

* * * * *